US005235708A

United States Patent [19]

Hart

[11] Patent Number: 5,235,708

[45] Date of Patent: Aug. 17, 1993

[54] SPA STEP UNIT SYSTEM

[75] Inventor: Derek W. Hart, Canby, Oreg.

[73] Assignee: D. W. Hart Woodworking, Canby, Oreg.

[21] Appl. No.: 759,416

[22] Filed: Sep. 13, 1991

[51] Int. Cl.[5] ..... E04H 4/14

[52] U.S. Cl. ..... 4/496; 4/546

[58] Field of Search ..... 4/494, 496, 506, 538, 4/546; 108/51.1, 65; 312/235.5; 52/813, 821, 827, 828

[56] References Cited

U.S. PATENT DOCUMENTS

| | | | |
|---|---|---|---|
| 1,810,579 | 6/1931 | Schmitz | 52/783 |
| 1,969,489 | 8/1934 | Wege | 52/783 |
| 2,021,751 | 11/1935 | Straubel | 52/783 |
| 2,032,878 | 3/1936 | Hunter | 52/783 |
| 3,067,843 | 12/1962 | Rushtoh et al. | 52/828 |
| 5,118,095 | 6/1992 | Flor | 248/346 X |

OTHER PUBLICATIONS

"The Spa Setting" brochure for Hot Spring Spa (Carlsbad, Calif., 1987).

"Tread-Loc Support System," *Aqua* (Jan. 1991), p. 29.

"Durastep ROVEL ® Pool Entry Stairs," *Pool & Spa News* (Feb. 11, 1991), p. 27.

"Classic Decks," *D. W. Hart Woodworking Catalog* (1991).

"Catalina Spas" and Caribbean Spas advertisement (Kansas City, Mo., 1991).

*House and Garden* (Jul. 1978), p. 80.

*Primary Examiner*—William A. Cuchlinski, Jr.

*Assistant Examiner*—W. Morris Worth

*Attorney, Agent, or Firm*—Klarquist, Sparkman, Campbell, Leigh & Whinston

[57] ABSTRACT

A hot tub spa assembly includes a hot tub spa having at least a portion thereof surrounded by at least one spa step unit. The spa step unit includes a wooden frame structure having an upper frame surface with deck planking secured thereto. The deck planking is sized to conform and fit around a portion of the spa. The step unit includes a thin-walled C-shaped border channel of a plastic material having an upright web with upper and lower flanges extending therefrom. The border channel is secured to the frame structure to form a load-bearing boundary portion of the frame. The deck planking is secured to the upper flange of the border channel to provide a spa step unit having an aesthetically pleasing appearance. A method is also provided of manufacturing the spa step unit.

8 Claims, 5 Drawing Sheets

SPA STEP UNIT SYSTEM

BACKGROUND OF THE INVENTION

The present invention relates generally to a hot tub spa assembly, and more particularly to an improved spa step unit for surrounding a portion of a hot tub spa, and to an improved method of manufacturing a spa step unit.

A variety of wooden spa steps and step units have been made in the past for surrounding a hot tub spa. These earlier spa step units are typically constructed totally of redwood for its aesthetically appearance and superior outdoor weatherability characteristics. However, these all-redwood spa steps are extremely heavy, and the more complex patterns, having many pieces, are difficult to assemble. Redwood step units having a curved upright exterior surface are particularly difficult to construct. Such a curved upright surface requires a plurality of vertical relief cuts into the interior side of the board. The upright board is then bent around interior framework, bonded with a marine glue, and clamped in place while the marine glue dries, taking from one to several days. Thus, valuable shop space is consumed during the glue drying process and valuable manufacturing time is lost while the glue dries.

Other step units have been proposed which are constructed totally of molded plastic. These molded steps require extensive metal or plastic bracing and framework under the steps to provide a suitable degree of structural integrity. Such all-plastic molded step units lack the warm and aesthetically pleasing appearance of the redwood steps. Furthermore, the molded step units are often too expensive to be practical for most residential hot tub spas applications.

Thus, a need exists for an improved hot tub spa assembly, an improved spa step unit for surrounding a portion of a hot tub spa, and an improved method of manufacturing a spa step unit, which is directed toward overcoming, and not susceptible to, the above limitations and disadvantages.

SUMMARY OF THE INVENTION

According to one aspect of the present invention, a spa step unit is provided for surrounding a portion of a hot tub spa. The step unit includes a wooden frame structure comprising at least one upright T-shaped frame member forming upper and lower frame surfaces and a plurality of frame ends. The spa step unit also has upper step surface forming wooden deck planking secured to the upper frame surface. The deck planking defines a step periphery having a spa conforming portion conformed to fit adjacent an exterior portion of the spa. The spa step unit also includes a thin-walled C-shaped border channel of a plastic material having a longitudinal upright web with longitudinal upper and lower flanges extending substantially horizontally from the upright web. The border channel is secured to at least one frame member with the upper and lower flanges form a load-bearing boundary portion of the respective upper and lower frame surfaces. At least a portion of the deck planking is secured to the border channel upper flange. The border channel extends under the deck planking about at least a portion of the step periphery.

According to another aspect of the present invention, a hot tub spa assembly is provided which has a hot tub spa with a water receiving interior tub portion and an upright exterior wall. The hot tub spa assembly also includes a spa step unit for surrounding at least a portion of the spa exterior wall. The spa step unit may be as described above. In an illustrated embodiment, the border channel of the step unit and the exterior wall of the hot tub spa are each of the same type of plastic material.

According to a further aspect of the present invention, a method is provided of manufacturing a spa step unit for surrounding an exterior portion of a hot tub spa. The method includes the step of assembling a wooden frame structure by attaching a cleat member to a base member for form a frame member having an upright T-shaped cross section. The frame structure has upper and lower frame surfaces and a plurality of frame ends. The method also includes a step of providing a C-shaped border channel of a plastic material. The border channel has a longitudinal upright web with longitudinal upper and lower flanges extending substantially horizontally from the upright web. In a removing step, relief portions are removed from the upper and lower flanges of the border channel adjacent any desired border curve and corner locations. In a securing step, the formed border channel is secured to the wooden frame structure in a desired border configuration including any desired border curves and corners. In a sizing step, deck planking is sized to define an upper step surface having a step periphery with a spa conforming portion conformed to fit adjacent the exterior portion of the spa. The method also includes the step of securing the sized deck planking to the cleat members of the frame structure and to the border channel upper flange to form an upper step surface of the spa step unit.

An overall object of the present invention is to provide an improved spa step unit for surrounding a portion of a hot tub spa.

A further object of the present invention is to provide an improved hot tub spa assembly.

Another object of the present invention is to provide an improved method of manufacturing a spa step unit for surrounding an exterior portion of a hot tub spa.

Still another object of the present invention is to provide a spa step unit which is lighter in weight and may be manufactured from less parts than earlier all-redwood spa step units.

Yet another object of the present invention is to provide a spa set unit having an aesthetically pleasing appearance, which is highly weatherable, and which conserves limited redwood resources.

A further object of the present invention is to provide a spa step unit which may be color coordinated with a hot tub spa which it surrounds.

Yet another object of the present invention is to provide an improved spa step unit and a method of manufacturing the same which is more readily assembled and has fewer parts than all-redwood step units.

The present invention relates to the above features individually as well as collectively. These and other objects, features and advantages of the present invention will become apparent to those skilled in the art from the following description and drawings.

BRIEF DESCRIPTION OF THE DRAWINGS

FIGS. 7–12 illustrate one form of a method of manufacturing one form of a spa step unit of the present invention, wherein:

FIGS. 7 and 8 are perspective views of one form of a bending fixture of the present invention;

FIG. 9 is a plan view during manufacture of a portion of one form of a border channel of the present invention;

FIG. 10 is a perspective view of one manner of assembling one form of a wooden frame structure of the present invention;

FIG. 11 is a top plan view of one form of a method of securing the border channel of FIG. 9 to the assembled wooden frame structure of FIG. 10; and FIG. 12 is an elevational view of one form of securing sized deck planking to the upper frame surface.

DETAILED DESCRIPTION OF A PREFERRED EMBODIMENT

Figure 1:
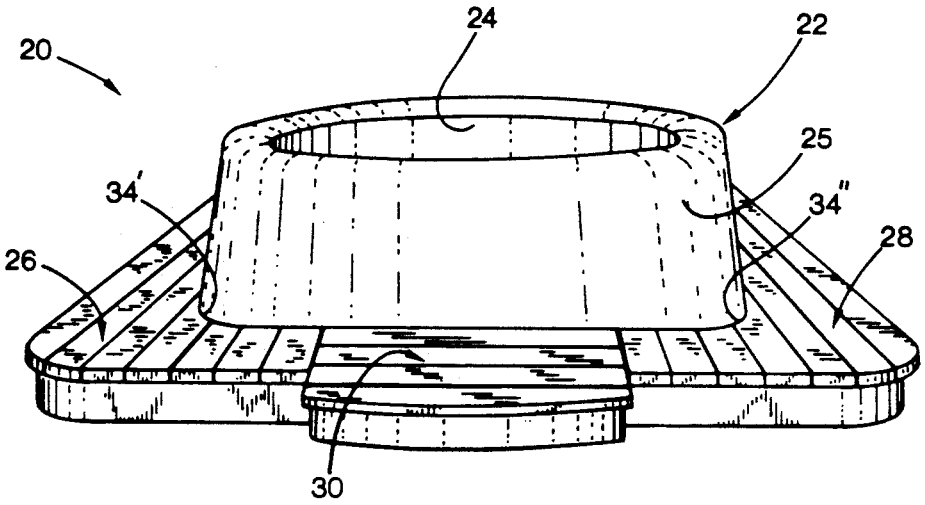
FIG. 1 is a perspective view of one form of a hot tub spa assembly of the present invention.

FIG. 1 illustrates an embodiment of a hot tub spa assembly 20 constructed in accordance with the present invention. The spa assembly 20 includes a hot tub spa 22 which may be of a conventional design having a water receiving interior tub portion 24 and an upright exterior wall 25. The spa exterior wall 25 may be of a variety of materials including plastics or wood, such as redwood. In a preferred embodiment, the spa exterior wall is of a plastic having superior weatherability characteristics, such as a weatherable polymer sold by The Dow Chemical Company of Midland, Mich., under the trademark ROVEL®. The spa assembly 20 also includes at least one, and preferably a plurality of spa step units, such as left, right and central step units 26, 28 and 30, respectively. Each of the step units 26, 28 and 30 may be constructed in a similar fashion, and for illustration the construction of spa step unit 30 is described in detail below.

Figure 2:
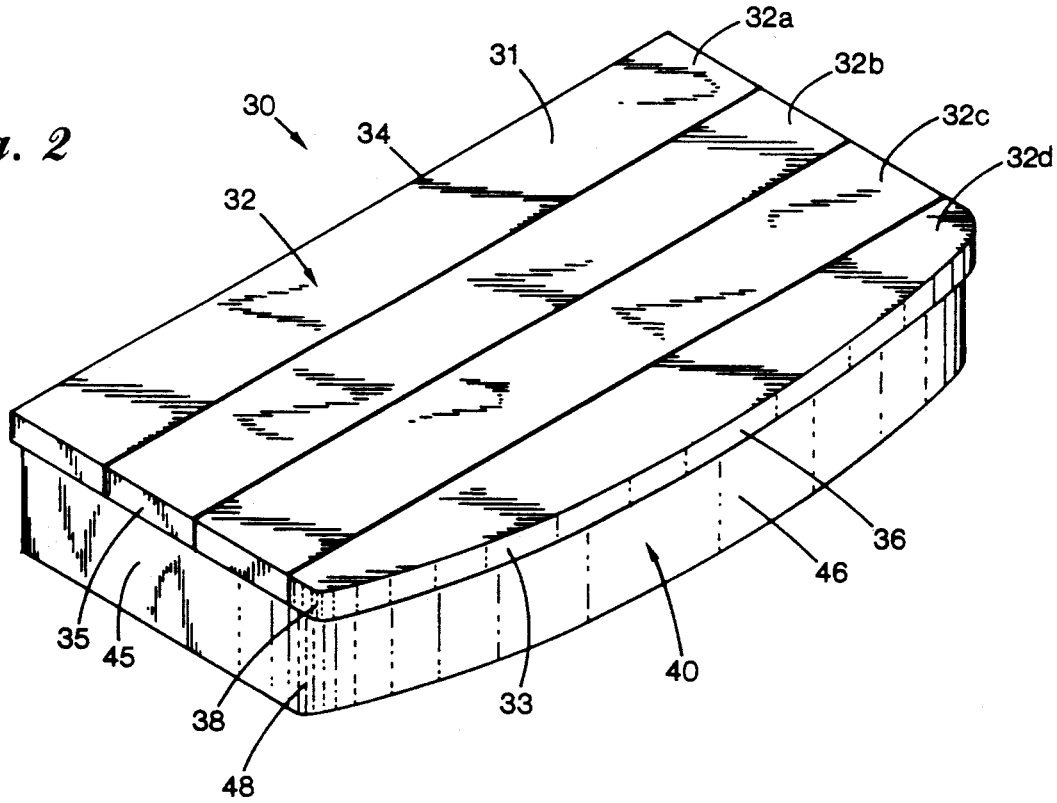
FIG. 2 is a perspective view of one form of a spa step unit of the present invention.

Referring now to FIG. 2, the spa step unit 30 has an upper step or deck surface 31 provided by wooden deck planking 32 comprising side-by-side boards 32*a*, 32*b*, 32*c* and 32*d*. The deck planking 32 is preferably of a weatherable type of wood, such as redwood, which lends an aesthetic appeal to the spa assembly 20. The deck planking 32 is cut to size to define a step periphery 33. The step periphery 33 has a spa conforming portion 34 which is conformed to fit adjacent the portion of the spa exterior wall 25 which is surrounded by the step unit 30. For example, in FIG. 1, the exterior wall 25 is relatively straight along the portion where step unit 30 is located. However, the left and right step units 26 and 28 have step peripheries with curved spa conforming portions 34' and 34", respectively, to conform to the curved corner portions of the spa wall 25. The deck planking 32 may also be sized to provide step periphery 33 with a straight portion, such as shown at 35, a curved portion 36, and a corner portion, such as corner 38.

The step unit 30 also has a thin-walled C-shaped border channel 40 of a plastic material. The plastic material may be any type of weatherable plastic having a suitable ultraviolet (uV) characteristic and structural strength capable of performing a load-bearing function as described herein. One particularly preferred type of plastic is The Dow Chemical Company's ROVEL® weatherable polymer. Use of the same type of plastic material for the border channel 40 as used for the exterior wall 25 of the hot tub 22 provides a pleasing appearance to the overall spa assembly 20. Furthermore, the border channel 40 and the hot tub exterior wall 25 may be color coordinated.

Figure 3:
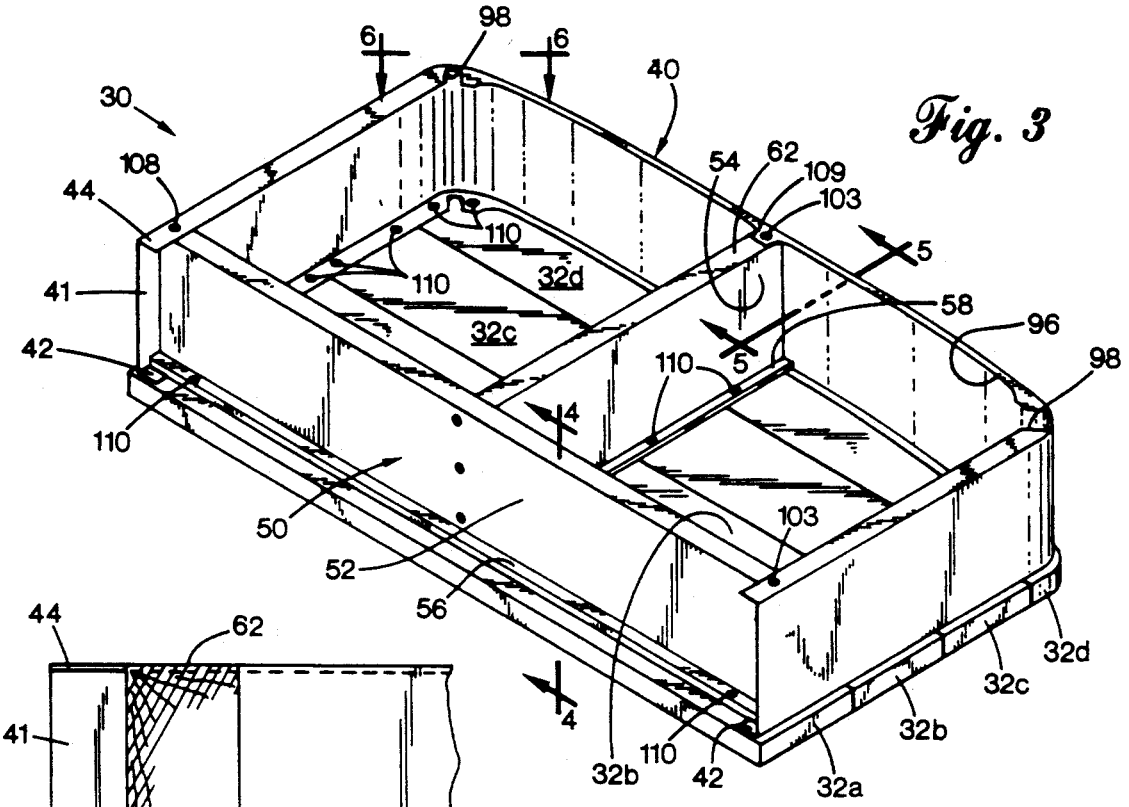
FIG. 3 is a perspective view of the spa step unit of FIG. 2 shown inverted.

Referring also to FIG. 3, the border channel 40 has a longitudinal upright web portion or web 41. The border channel 40 also has longitudinal upper and lower portions or flanges 42 and 44, respectively, extending substantially horizontally from upper and lower edges of the web 41. In the illustrated embodiment, the border channel 40 is formed as a single unitary integral member. The border channel 40 extends under the deck planking 32 about at least a portion of the step periphery 33. The illustrated border channel 40 has a straight portion 45, a curved portion 46, and a corner portion or corner 48. Each of the border portions 45, 46 and 48 are located to correspond to the straight portion 35, the curved portion 36, and the corner 38, respectively, of the step periphery 33.

Figure 4:
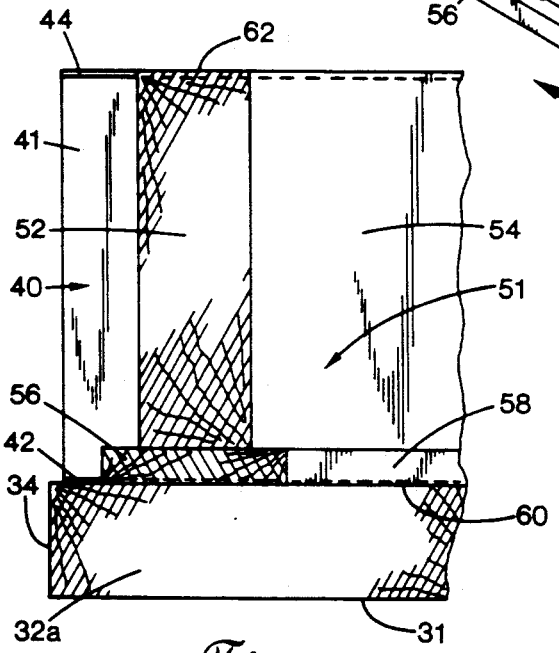
FIG. 4 is a partially cutaway enlarged vertical sectional view taken along line 4—4 of FIG. 3.

The spa step unit 30 also has a wooden frame structure 50 to which the border channel 40 and deck planking 32 are secured as described further below. As shown in FIG. 4, wooden frame structure 50 includes at least one upright T-shaped frame member 51 which may be constructed as follows. For the illustrated step unit 30, the frame structure 50 includes two base members or baseboards 52 and 54, which may be of redwood. To facilitate attaching the planking 32 to the frame structure 50, two cleat members or cleats 56 and 58 are secured to an upper surface of the respective baseboards 52 and 54. The joined baseboards and cleats, provides the T-shaped frame member, such as 51 shown in FIG. 4. Note that while FIG. 4 shows the cross section taken from the inverted view of FIG. 3, the T-shaped member 51 is in an upright position during normal (see FIGS. 1 and 2).

Figure 5:
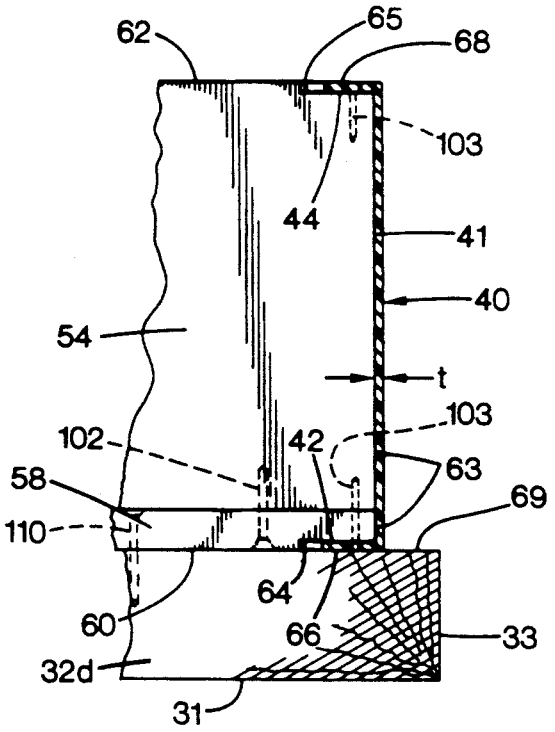
FIG. 5 is a partially cutaway enlarged vertical sectional view taken along line 5—5 of FIG. 3.

Referring to FIG. 5, the wooden frame structure 50 has an upper frame surface 60, provided in part by an upper surface of the cleats 56 and 58. The frame structure 50 also has a lower frame surface 62, provided in part by the lower surface of the baseboards 52 and 54. The illustrated border channel 40 has a thickness t which is uniform throughout the web and flanges 41, 42 and 44. To provide uniform upper and lower frame surfaces 60 and 62, the T-shaped frame members 51 may have recesses formed therein to receive the thickness t of the border flanges 42 and 44.

For example, the border channel 40 is secured to the frame structure 50 at several of the frame ends, such as frame end 63 comprising the distal ends of baseboard 54 and cleat 58. Adjacent frame end 63, the frame surfaces 60 and 62 each have border receiving recesses 64 and 65, respectively, formed therein. The recesses 64 and 65 are configured to accommodate the thickness t and the size of the upper and lower flanges 42 and 44. The recesses 64 and 65 each have a depth which allows the respective upper and lower surfaces of the upper and lower flanges 42 and 44 to lie substantially coplanar with the respective upper and lower frame surfaces 60 and 62.

In this manner, with the web 41, the border flanges 42 and 44 form load-bearing boundary portions 66 and 68 of the respective upper and lower frame surfaces 60 and 62. In the illustrated embodiment, using a border channel 40 of ROVEL®, a thickness t of one-eighth inch provides the desired structural integrity to support the deck planking 32. Note also, the illustrated border channel 40 is recessed inwardly from the step periphery 33 to form a small deck overhang 69.

Figure 6:
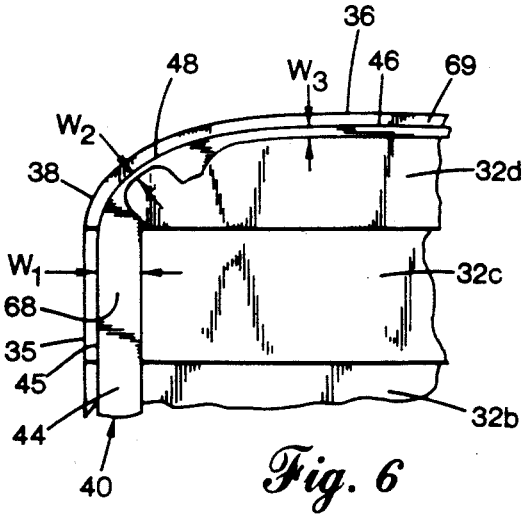
FIG. 6 is a partially cutaway enlarged bottom plan view taken along lines 6—6 of FIG. 3.

FIG. 6 illustrates a manner of relieving the border channel corner and curved portions 48 and 46 to provide for smooth corners and curves while maintaining the structural integrity and load-bearing function of the channel 40. For example, along the straight portion 45, the lower flange 44 has a maximum width $W_1$. At the corner 48, the flange has a width $W_2$ narrower than width $W_1$. Along the curved portion 46, the flange has a width $W_3$, which is substantially narrower than width $W_1$, but not as narrow as the width $W_2$ at corner 48.

Figure 7:
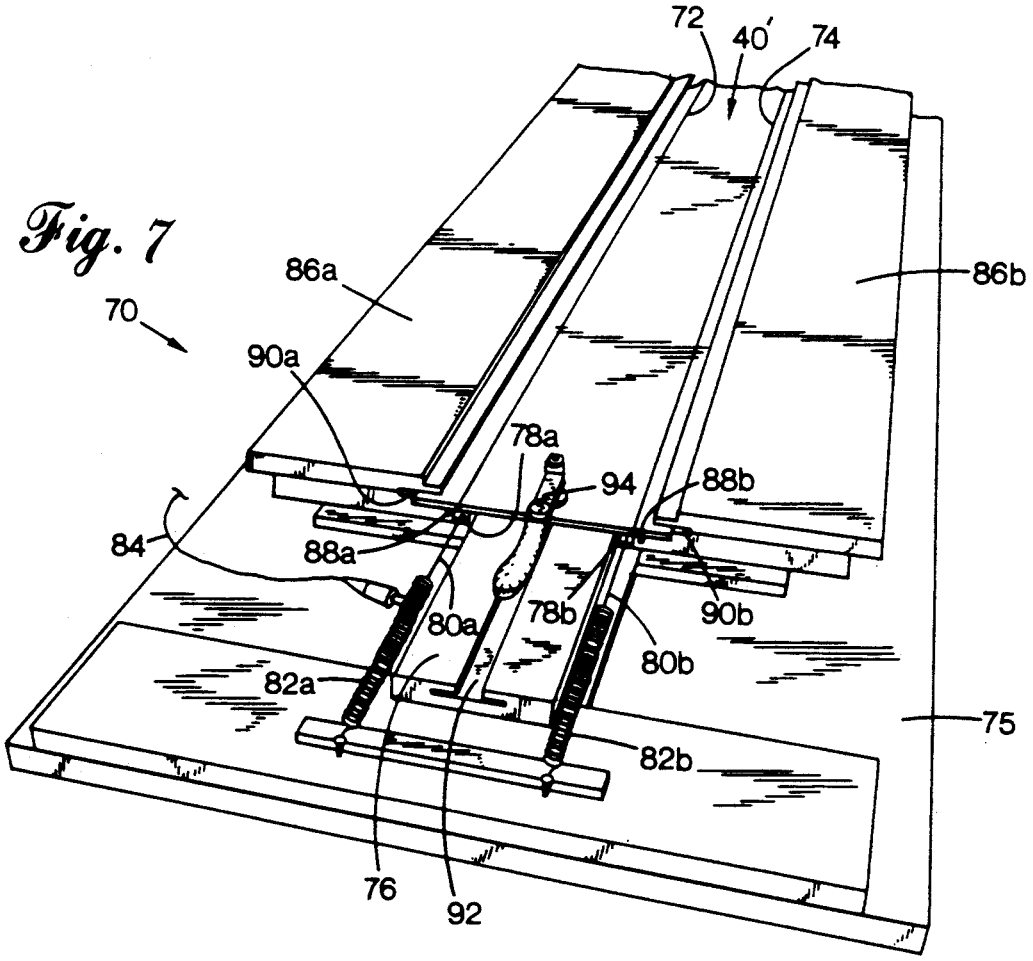

A method a manufacturing a spa step unit will now be described with reference to FIGS. 7–12 which illustrate the manufacture of step unit 30. FIG. 7 shows a portion of a sheet 40′ of the plastic material of the finished border channel 40. The sheet 40′ has been cut into a rectangular shape and placed in a bending fixture 70. Prior to placing sheet 40′ in the bending fixture 70, two score lines 72 and 74 are scored along what will become the interior surface of the border channel 40. The score lines 72 and 74 may be scored, for instance, using a table saw (not shown).

Figure 8:
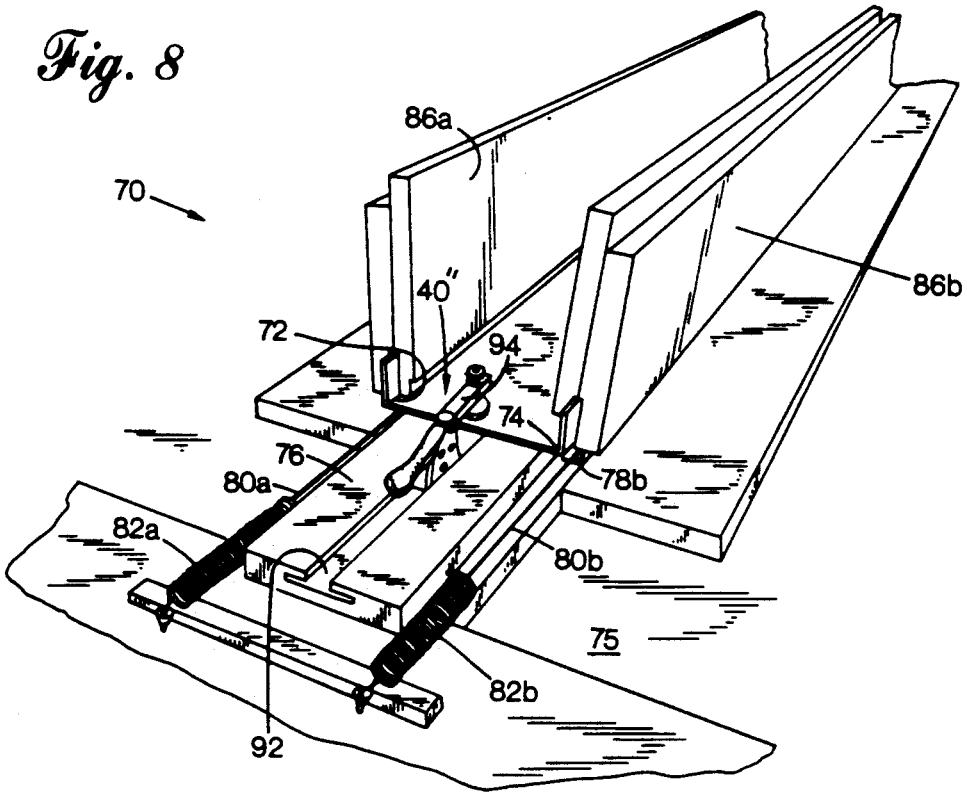

The bending fixture 70 has a frame 75 with a bending table or platform 76 secured thereto. Recessed beneath the bending platform 76 are two insulated heating wire channels 78*a* and 78*b*. Heating elements, such as nichrome wires 80*a* and 80*b*, are received within the respective channels 78*a* and 78*b*. The heating wires 80*a* and 80*b* are secured to the frame 85 by springs 82*a* and 82*b*. The springs 82*a*, 82*b* take up slack in the heating wires 80*a*, 80*b* during heating (compare FIG. 7, showing the cooled state, with FIG. 8, showing the heated state of fixture 70).

Heating is accomplished by applying a variable voltage source (not shown) to wires 80*a* and 80*b*, for example, using the electrical conductor lead 84. It is apparent that there are a variety of ways in which power can be applied to the resistive heating element wires 80*a* and 80*b*, and additional conductors may be used, beyond the illustrated conductor 84 shown in FIG. 7. Although a variety of voltage sources may be used, one particularly suitable source is the Model No. 1510 Series Variable Transformer, which may be obtained from Norvac Electronics Inc. of Beaverton, Oreg. 97005.

Two bending members 86*a* and 86*b* are pivoted to the bending platform 76 by continuous hinges 88*a* and 88*b*. The bending members 86*a* and 86*b* each have a flange receiving recess 90*a* and 90*b*, respectively, formed therein to receive what will after forming become the border flanges 42 and 44. The bending platform 76 has a clamp receiving recess 92 to slidably receive an adjustable clamp unit 94 which secures sheet 40′ in place during bending.

The clamp unit 94 may be slidably removed from recess 92 to allow the scored rectangular plastic sheet 40′ to be slidably received within the bending member recesses 90*a* and 90*b*. Once the rectangular sheet 40′ is in place, the clamp unit 94 is adjusted within recess 92 to clamp the rectangular sheet 40′ in place relative to the bending platform 76. The sheet 40′ is located in fixture 70 with the score lines 72 and 74 aligned with the heating elements 80*a* and 80*b*, respectively. Power is then applied to each of the heating elements 80*a* and 80*b* from the variable power source (not shown) through conductors, such as conductor 84.

When the rectangular sheet 40′ has reached a desired warmth and achieved a desired flexibility, the bending members 86*a* and 86*b* are raised as shown in FIG. 8 to bend the rectangular sheet 40′ along the score lines 72 and 74. Preferably, the bent channel 40″ of FIG. 8 is allowed to cool in place within the bending fixture 70. Upon cooling, the bent channel 40″ retains its C-shape. When the bent channel 40″ has cooled, the clamp unit 94 is released and removed from recess 92, allowing channel 40″ to be slidably removed from the bending fixture 70.

Figure 9:
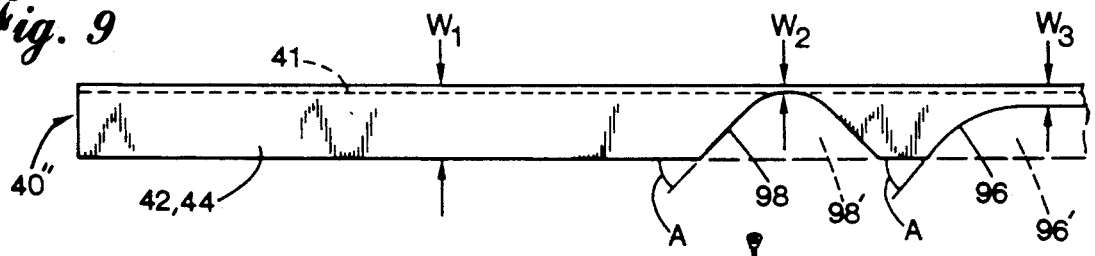

FIG. 9 shows a plan view of a portion of bent channel 40″, which for the illustrated symmetrical border channel 40, may represent either a top plan view of the upper flange 42 or a bottom plan view of the lower flange 44. In FIG. 9, relief portions 96′ and 98′ have been cut and removed from the flanges 42 and 44. The relief portion 96′ is removed along the curved wall 46 to form the gently arcing relieved portion 96 having the width $W_3$. Similarly, the corner relief portion 98′ is removed to provide the gently arcing corner relieved portion 98 with a minimum width $W_2$ at what will become one of the channel corners, such as corner 48. Preferably, the relief portions 96′ and 98′ are cut at an angle A with respect to the edge of the flange, with approximately 45° being a particularly preferred value for angle A.

Figure 10:
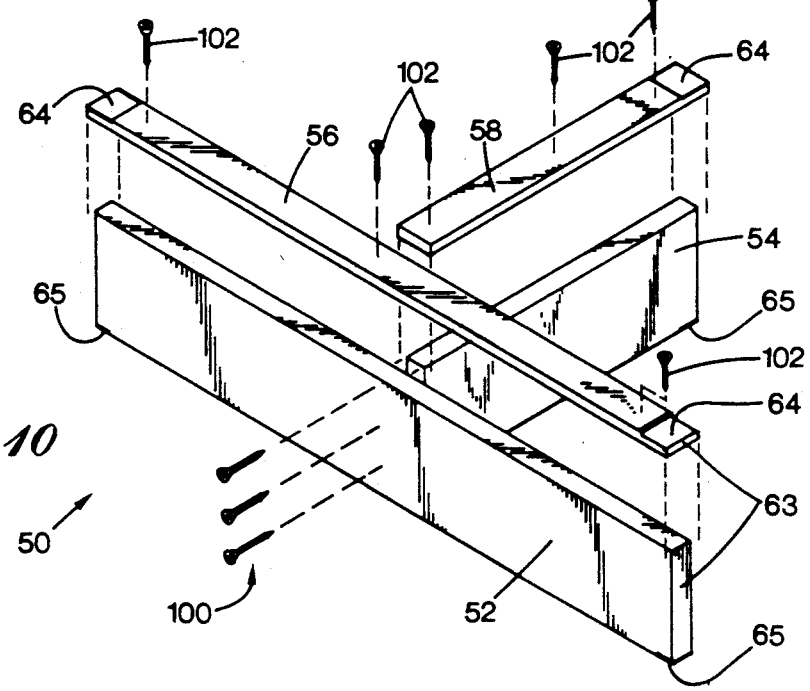

FIG. 10 illustrates the assembly of the illustrated wooden frame structure 50. The base members 52 and 54 are joined together, for example by screws 100. The cleats 56 and 58 are attached to the respective base members 52 and 54 by screws 102. Prior to assembling the frame structure 50 as shown in FIG. 10, the upper and lower border receiving recesses 64 and 65 may be formed adjacent the frame ends 63 in the respective cleat members 56, 58 and baseboards 52, 54.

Figure 11:
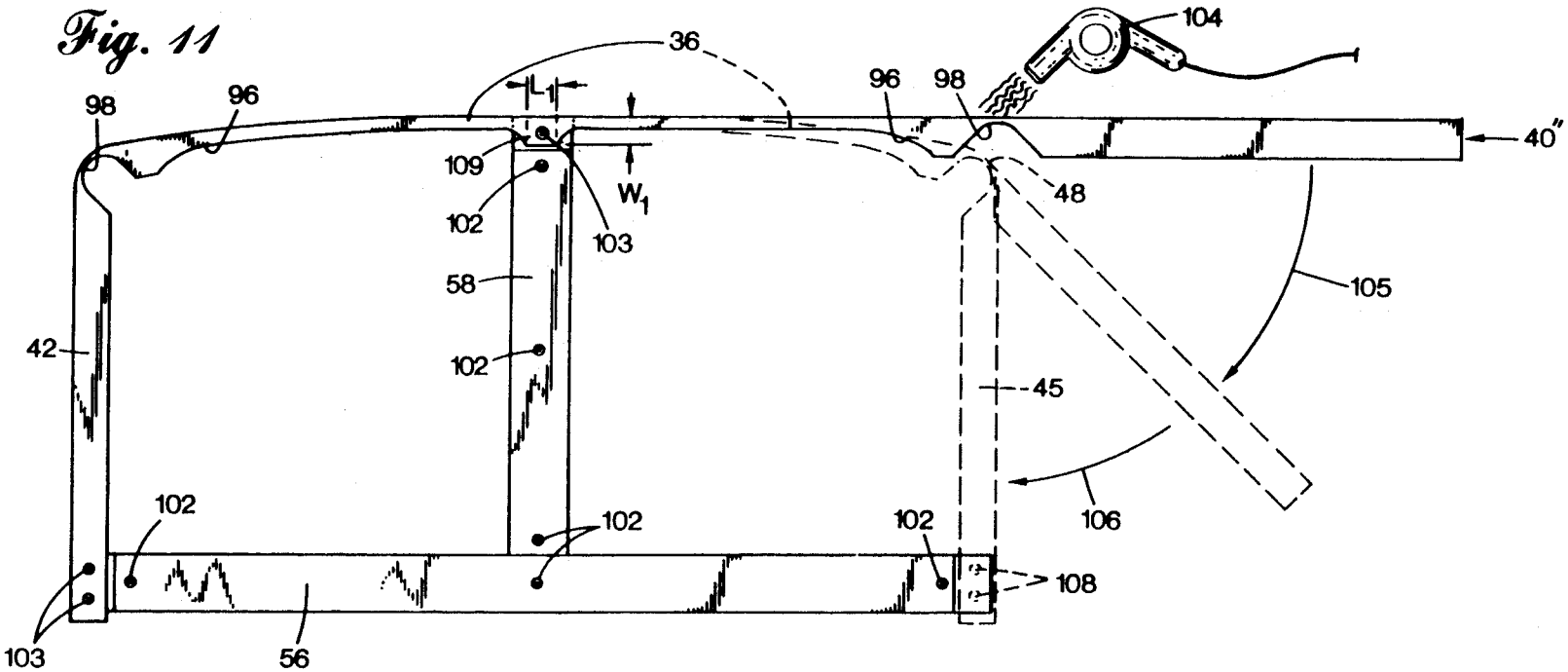

Referring now to FIG. 11, the bent border channel 40″ of FIG. 9 is shown being secured to the assembled frame structure 50 of FIG. 10 to provide a desired border configuration including two desired border corners and a desired border curve. The portion of the bent channel 40″ to the left in FIG. 11 has already been attached to the frame structure 50, in the same manner as described below with respect to the securing of the right portion of the bent channel 40″. The border channel is secured to the frame structure 50 using screws 103 (see FIG. 5).

To form the border corners, such as corner 48, heat is applied from an external source, such as from heat gun 104, to the border channel 40″ adjacent the relieved portion 98. The heat allows the bent channel 40″ to become supple and flexible enough to be bent as shown by arrows 105 and 106 to a position where it may be secured to the frame structure 50 with screws (not shown) at 108. A gentle border curve, such as curve 46, may typically be formed without using heat gun 104 or the like, by adjusting the length of the T-shaped frame member 51, here comprising the baseboard 54 and cleat 58. That is, a greater arc may be obtained by lengthening the baseboard 54 and cleat 58, and by providing a correspondingly greater distance between the two corner relieved portions 98, 98. Furthermore, the border channel upper and lower surfaces may have an attachment tab 109 of width $W_1$ of varying lengths. For example, by increasing the length $L_1$ of the tab 109, a straight section (not shown) may be introduced into what is shown as a continual curve 36.

Figure 12:
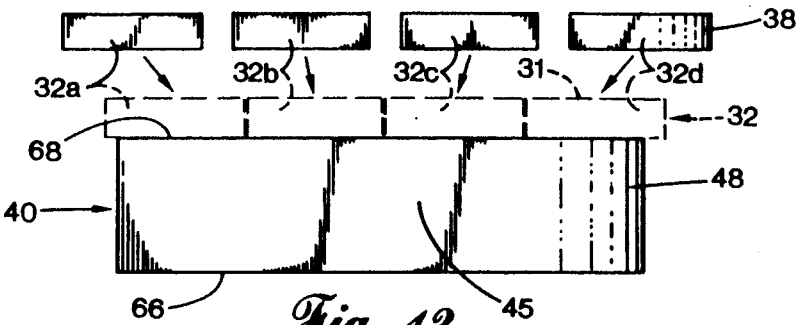

FIG. 12 illustrates a step of securing the deck planking 32 to the upper border flange 42 and to the cleats 56 and 58 of the frame structure 50. The deck planking is preferably sized to provide the desired step periphery 33 before the planking is secured to the border channel and frame structure. As best shown in FIG. 3, the planking 32 is secured to the upper frame surface 60 by screws such as 110 extending through the cleats 56 and 58 and through the border channel upper flange 42. This advantageously provides a smooth deck surface 31 which is free of fastener heads, so as to avoid injury from loosened exposed fastener heads.

The use of border channel 40 advantageously provides a spa step unit that is lighter in weight, uses less parts, and easier to construct than earlier all redwood step units. The spa step unit described herein retains the aesthetically pleasing wooden deck surface 31, which is not possible using the earlier all-plastic molded step units. Furthermore, the spa step unit described herein may advantageously be color coordinated with the exterior 25 of a hot tub spa.

Having illustrated and described the principles of my invention with respect to a preferred embodiment, it should be apparent to those skilled in the art that my invention may be modified in arrangement and detail without departing from such principles. For instance, other structural equivalents or other devices known to be interchangeable by those skilled in the art may be implemented. For example, other fastening means may be employed to secure together the various components of the spa step unit described herein. Furthermore, other configurations and combinations of step units other than units 26, 28 and 30 may be used to surround at least a portion, or the totality of, the hot tub spa 22. Also, suitable material substitutions and dimensional variations may be employed for the components of the spa assembly 20 and the spa step units. I claim all such modifications falling within the scope and spirit of the following claims.

I claim:

1. A spa step unit for surrounding an exterior portion of a hot tub spa, comprising:

a wooden frame structure comprising a T-shaped upright frame member having upper and lower frame surfaces and a plurality of frame ends;

wooden deck planking secured to the upper frame surface, the planking forming an upper step surface and defining a step periphery, the step periphery having a spa conforming portion conformed to fit adjacent the spa exterior portion; and a thin-walled C-shaped border channel of a plastic material secured to the frame member, the channel having a longitudinal upright web terminating in upper and lower flanges extending from a single side of the web, the channel extending under and supporting the deck planking around at least a portion of the step periphery, with the flanges extending an inward direction away from the step periphery and the upper flange having at least a portion of the deck planking secured thereto.

2. A spa step unit according to claim 1 wherein:

the step periphery has a straight portion and a curved portion; and the border channel upper and lower flanges have a first width adjacent the straight portion and a second width less than the first width adjacent the curved portion.

3. A spa step unit according to claim 1 wherein:

the border channel flanges each have a predetermined thickness, with the upper flange having an upper border surface and the lower flange having a lower border surface;

the border channel is secured to at least one of the frame ends; and the upper and lower frame surfaces adjacent the at least one of the frame ends to which the border channel is secured each have a border receiving recess formed therein, with each recess configured to accommodate the predetermined thickness so the upper and lower border surfaces are substantially coplanar with the respective upper and lower frame surfaces.

4. A hot tub spa assembly, comprising:

a hot tub spa having a water receiving interior tub portion and an upright exterior wall; and a spa step unit for surrounding at least a portion of the hot tub spa exterior wall, with the spa step unit including:

a wooden frame structure comprising a T-shaped upright frame member having upper and lower frame surfaces and a plurality of frame ends;

wooden deck planking secured to the upper frame surface, the planking forming an upper step surface and defining a step periphery, the step periphery having a spa conforming portion conformed to fit adjacent the surrounded portion of the hot tub spa exterior wall; and a thin-walled C-shaped border channel of a plastic material having a longitudinal upright web with longitudinal upper and lower flanges extending substantially horizontally from the upright web, the border channel secured to at least one frame member with the upper and lower flanges forming a load-bearing boundary portion of the respective upper and lower frame surfaces, the border channel upper flange having at least a portion of the deck planking secured thereto, with the border channel extending under the deck planking about at least a portion of the step periphery.

5. A hot tub spa assembly according to claim 4 wherein the exterior wall of the hot tub spa is of a plastic material of the same type as the plastic material of the border channel.

6. A hot tub spa assembly according to claim 4 wherein:

the step periphery has a straight portion and a curved portion; and the border channel upper and lower flanges have a first width adjacent the straight portion and a second width less than the first width adjacent the curved portion.

7. A hot tub spa assembly according to claim 6 wherein:

the border channel flanges each have a predetermined thickness, with the upper flange having an upper border surface and the lower flange having a lower border surface;

the border channel is secured to at least one of the frame ends; and the upper and lower frame surfaces, which are adjacent the at least one of the frame ends to which the border channel is secured, each have a border receiving recess formed therein, with each recess configured to accommodate the predetermined thickness so the upper and lower border surfaces are substantially coplanar with the respective upper and lower frame surfaces.

8. A spa step unit according to claim 1 wherein:

the step periphery has a straight portion and a curved portion;

the border channel flanges have a first width adjacent the step periphery straight portion and a second width less than the first width adjacent the step periphery curved portion, the flanges each also having a predetermined thickness, with the upper flange having an upper border surface and the lower flange having a lower border surface;

the border channel is secured to at least one of the frame ends; and the upper and lower frame surfaces, which are adjacent the at least one of the frame ends to which the border channel is secured, each have a border receiving recess formed therein, with each recess configured to accommodate the predetermined thickness so the upper and lower border surfaces are substantially coplanar with the respective upper and lower frame surfaces.

* * * * *